US007448624B2

(12) United States Patent
Lee

(10) Patent No.: US 7,448,624 B2
(45) Date of Patent: Nov. 11, 2008

(54) PAPER FEEDING DEVICE OF IMAGE FORMING APPARATUS AND IMAGE FORMING APPARATUS HAVING THE SAME

(75) Inventor: Jin-Soo Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 358 days.

(21) Appl. No.: 11/166,651

(22) Filed: Jun. 27, 2005

(65) Prior Publication Data

US 2006/0071419 A1 Apr. 6, 2006

(30) Foreign Application Priority Data

Sep. 6, 2004 (KR) ..... 10-2004-0070778

(51) Int. Cl.
*B65H 5/02* (2006.01)

(52) U.S. Cl. ..... 271/274

(58) Field of Classification Search ..... 271/273, 271/274, 258.01, 258.05; 192/226; 74/411.5
See application file for complete search history.

(56) References Cited

U.S. PATENT DOCUMENTS 5,368,290 A * 11/1994 Nanba et al. ..... 271/273
5,386,983 A * 2/1995 Ando ..... 271/118
5,544,580 A * 8/1996 Takahashi ..... 101/118
5,600,426 A * 2/1997 Gramlich et al. ..... 399/381
5,645,273 A * 7/1997 Nakagawa et al. ..... 271/10.1
5,934,664 A * 8/1999 Murayama et al. ..... 271/118
6,217,017 B1 * 4/2001 Yamazaki ..... 271/121
6,237,485 B1 * 5/2001 Fukai ..... 101/118
6,331,002 B1 * 12/2001 Yoshino et al. ..... 271/117
2001/0028146 A1 * 10/2001 Takata ..... 271/274
2006/0181015 A1 * 8/2006 Takahashi ..... 271/273

FOREIGN PATENT DOCUMENTS

| | | |
|---|---|---|
| JP | 01-150640 | 6/1989 |
| JP | 06-040105 | 2/1994 |
| JP | 2001-097576 | 4/2001 |
| KR | 10-0268134 | 7/2000 |
| KR | 2001-0011448 | 2/2001 |

* cited by examiner

*Primary Examiner*—Patrick Mackey
*Assistant Examiner*—Michael C McCullough
(74) *Attorney, Agent, or Firm*—Roylance, Abrams, Berdo & Goodman, L.L.P.

(57) ABSTRACT

Provided is a paper feeding device. The paper feeding device includes an image forming unit, a paper feeding unit to provide a transfer force to a first side and a second side opposite to the first side. The paper feeding unit has a roller portion to transfers the paper to the image forming unit and a paper-feeding controlling unit to operate the roller portion so as to interrupt the transfer force applied to the paper when a rear end of the paper passes through the roller portion.

18 Claims, 8 Drawing Sheets

PAPER FEEDING DEVICE OF IMAGE FORMING APPARATUS AND IMAGE FORMING APPARATUS HAVING THE SAME

CROSS-REFERENCE TO RELATED APPLICATIONS

This application claims the benefit under 35 U.S.C. 119(a) of Korean Patent Application No. 10-2004-0070778, filed on Sep. 6, 2004, the entire disclosure of which is hereby incorporated by reference.

FIELD OF THE INVENTION

The present invention relates to an image forming apparatus. More particularly, the present invention relates to a paper feeding device having a roller portion to prevent image quality from being effected by mechanical vibrations occurring on a rear end of a paper when an image is transferred.

DESCRIPTION OF THE RELATED ART

In general, an image forming apparatus, such as a laser beam printer, a LED printer, a digital copier, or a facsimile, is an apparatus which transfers an image signal in response to a digital signal input from a computer or a scanner onto a recording medium in the form of a visible image. The image forming apparatus comprises an image forming unit to form an image onto paper and a paper feeding device to feeding the paper to the image forming unit.

Referring to FIG. 1, a conventional paper feeding device 1 comprises a driving shaft 3 rotated by a driving source (not shown) such as a motor and a driving roller 2 attached to the driving shaft 3. A passive roller 5 closely adheres to the driving roller 2. The passive roller is rotatably driven by the driving roller 2. The passive roller 5 is installed by levers 10 arranged on both ends of the passive roller 5 for pivoting around a hinge shaft 7 at a predetermined angle. The passive roller 5 contacts the driving roller 2; however, the passive roller is separate therefrom. In this case, the passive roller 5 is elastically biased by a pressing spring 8 toward the driving roller 2. As stated above, the levers 10 pivot around the hinge shaft 7. One of the levers 10 has a mechanical interrupter 10*a* configured to engage with a rotating cam 12. The rotating cam 12 will be described later in more detail below. The rotating cam 12 interferes with the interrupter 10*a* so that the passive roller 5 pivots and separates from the driving roller 2. Moreover, an electronic clutch 14 may rotate the rotating cam 12 if necessary.

If the driving roller 2 of the paper feeding device 1 is rotated, the passive roller 5 and the driving roller 2 rotate together. A front end of the paper engages with roller portion 20. Roller portion 20 includes the driving roller 2 and the passive roller 5. The paper passes therebetween and is fed to an image forming unit (not shown). The front end of the paper passes through the image forming unit and an image is formed. However, since the roller portion 20 requires pressure to transfer the paper, an instantaneous shock is applied to the paper when the paper engages with the roller portion 20 and is transferred. Thus, as the rear end of the paper passes through the roller portion 20, the image formed on the paper may be distorted. Thus, when the rear end of the paper passes through the roller portion 20, the rotating cam 12 rotates to press the interrupter 10 so that the passive roller 5 separates from the driving roller 2.

As described above, since the conventional paper feeding device 1 is relatively complicated and requires parts such as the rotating cam 12 and the electronic clutch 14, it is difficult to manufacture and minimize the size of the conventional paper feeding device while reducing costs.

In addition, since the rotating cam 12 is installed separately from the roller portion 20, unnecessary external forces are applied to the paper when the rear end of the paper passes through the roller portion 20. Consequently, image quality may be degraded.

Accordingly, there is a need for an improved paper feeding device having a roller portion mounted thereon without the need for an additional driving unit.

SUMMARY OF THE INVENTION

An aspect of the present invention is to solve at least the above problems and/or disadvantages and to provide at least the advantages described below. Accordingly, an aspect of the present invention is to provide a image forming apparatus having a paper feeding device with a relatively simpler structure and comparatively minimal size.

The present invention also provides a paper feeding device which is mounted on a roller portion and separates the roller portion from the paper feeding device without the need of an additional driving unit and an image forming apparatus having the same.

According to an aspect of the present invention, there is provided a paper feeding device. The paper feeding device includes an image forming unit and a paper feeding unit to provide a transfer force to a first side and a second side opposite to the first side of a sheet of paper. The paper feeding device has a roller portion to transfer the paper to the image forming unit and a paper-feeding controlling unit to operate the roller portion so as to interrupt the transfer force applied to the paper when a rear end of the paper passes through the roller portion.

The roller portion may include a driving roller being rotated by a rotating force transferred from a driving source. The driving roller is arranged on a first shaft to face the first side of the paper. A passive roller is disposed parallel to the first shaft. The passive roller is arranged on a second shaft to face the second side of the paper to press the paper toward the driving roller under a predetermined pressure for rotating independent of the second shaft.

The paper-feeding controlling unit may include a controlling portion being installed on the second shaft to control the transfer force generated by the driving roller by making the first and second shafts contact each other or separate from each other; and a clutch portion to operate the controlling portion installed on the second shaft by transferring a rotating force to the second shaft to control the transfer force.

The clutch portion may include a stopper being a substantially pipe-shaped member substantially encasing the second shaft and is fixedly installed on the second shaft. A driving member is combined with an outer circumference of the stopper and being rotated by rotating force transferred from the driving source. A locking part is provided to lock or unlock the stopper so that the stopper is not rotated by rotating force. Thus, if the stopper is unlocked, the second shaft on which the stopper is fixedly installed may be rotated together with the stopper, the controlling portion installed on the second shaft may be rotated so that the first and second shafts are moved into contact with or separated from each other.

The stopper may include a protrusion protruding from the outer circumference of the stopper. The locking part may include a trigger to lock or unlock the stopper by positioning the protrusion so that the stopper is not rotated. A confinement member confines an operation of the trigger so that the trigger positions the protrusion into contact or releases the protrusion from the stopper.

The confinement member may include a solenoid to operate in response to an electrical signal.

The driving member may be a gear.

The controlling portion may be a cam member.

A pair of controlling portions being confined and rotated by the second shaft may be formed on both ends of the second shaft in the state where the driving roller is placed between the pair of controlling portions.

The first and second shafts may be wound by a coil spring installed on the first shaft and elastically biased to contact each other.

The device may further include a sensor to sense passage of the rear end of the paper when the paper passes between the driving roller and the passive roller.

According to another aspect of the present invention, there is provided an image forming apparatus having a paper feeding device. The paper feeding device includes an image forming unit having a paper feeding unit to provide a transfer force to a first side and a second side opposite to the first side of a sheet of paper. The paper feeding unit has a roller portion to transfer the paper to the image forming unit and a paper-feeding controlling unit to operate the roller portion so as to interrupt the transfer force applied to the paper when a rear end of the paper passes through the roller portion.

The roller portion may include a driving roller being rotated by a rotating force transferred from a driving source. The driving roller is arranged on a first shaft to face the first side of the paper A passive roller is parallel to the first shaft and is arranged on a second shaft to face the second side of the paper to press the paper toward the driving roller under a predetermined pressure for rotating independent of the second shaft.

The paper-feeding controlling unit may include a controlling portion being installed on the second shaft to control the transfer force generated by the driving roller by making the first and second shafts contact or separate from each other. A clutch portion operates the controlling portion installed on the second shaft by transferring a rotating force to the second shaft to control the transfer force.

The clutch portion may include a stopper being substantially pipe-shaped member and substantially encasing the second shaft. The clutch portion is fixedly installed on the second shaft. A driving member is combined with an outer circumference of the stopper and is rotated by rotating force transferred from the driving source and a locking part to lock or unlock the stopper so that the stopper is not rotated by a rotating force. If the stopper is unlocked, the second shaft on which the stopper is fixedly installed may be rotated together with the stopper. The controlling portion is installed on the second shaft and may be rotated so that the first and second shafts are moved into contact with or separated from each other.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
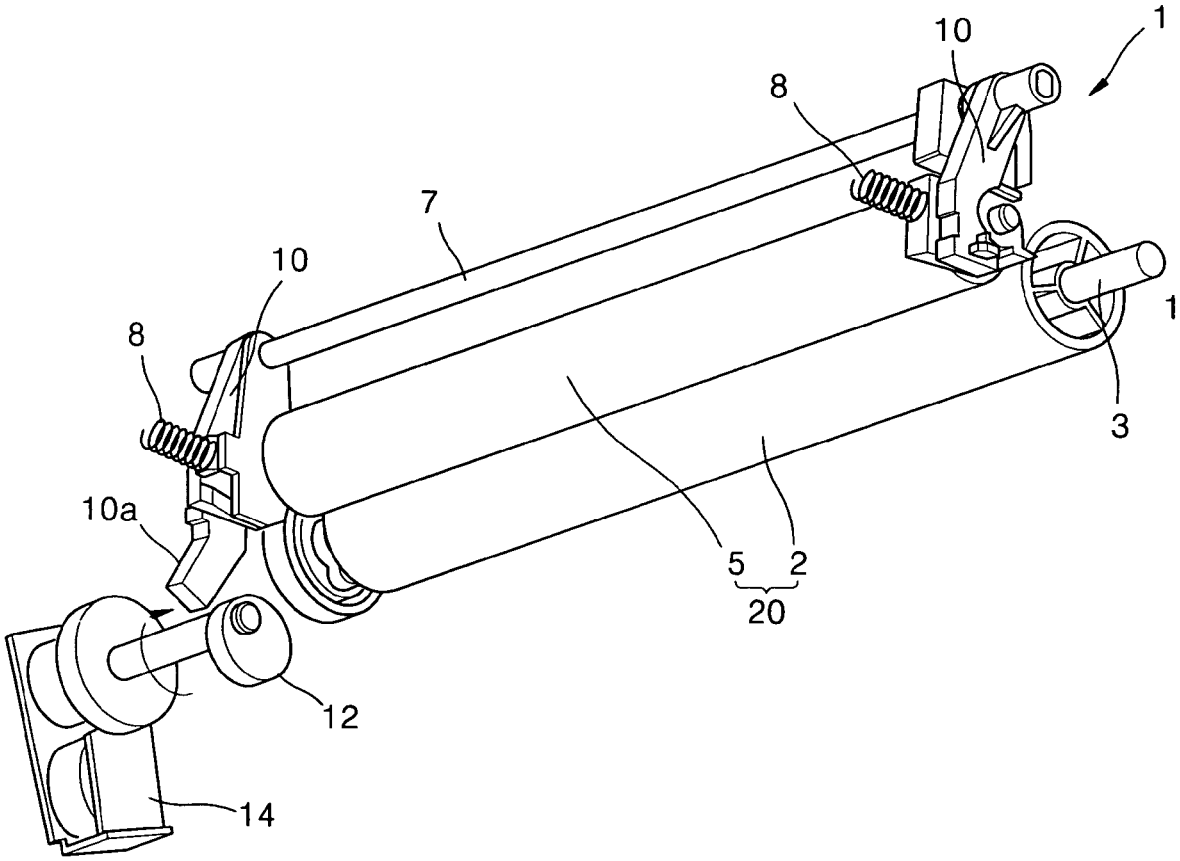
FIG. 1 (PRIOR ART)
FIG. 1 is a perspective view of an example of a conventional paper feeding device used in an image forming apparatus.
Figure 2:
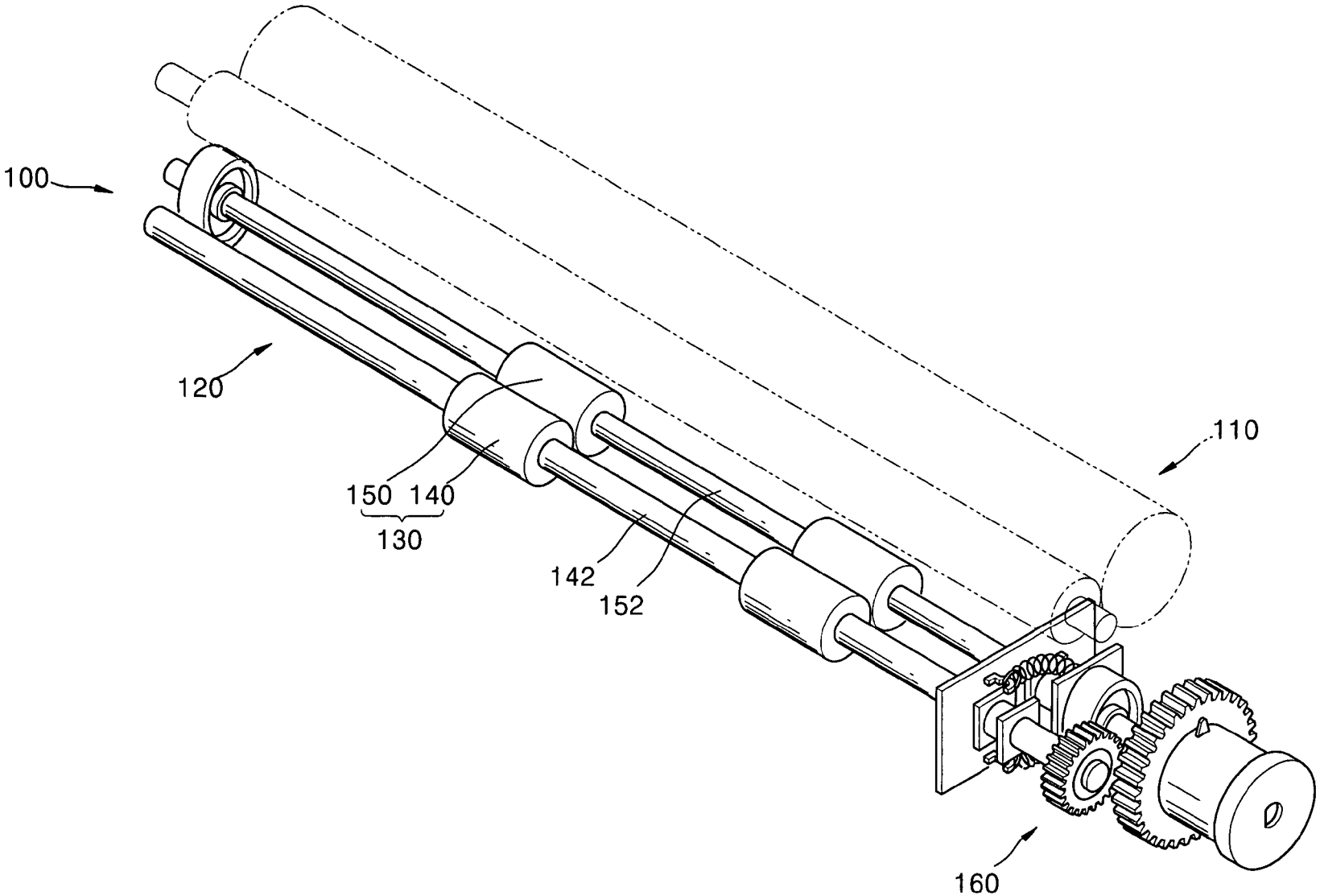
FIG. 2 is a perspective view of a paper feeding device in accordance with an embodiment of the present invention.
Figure 3:
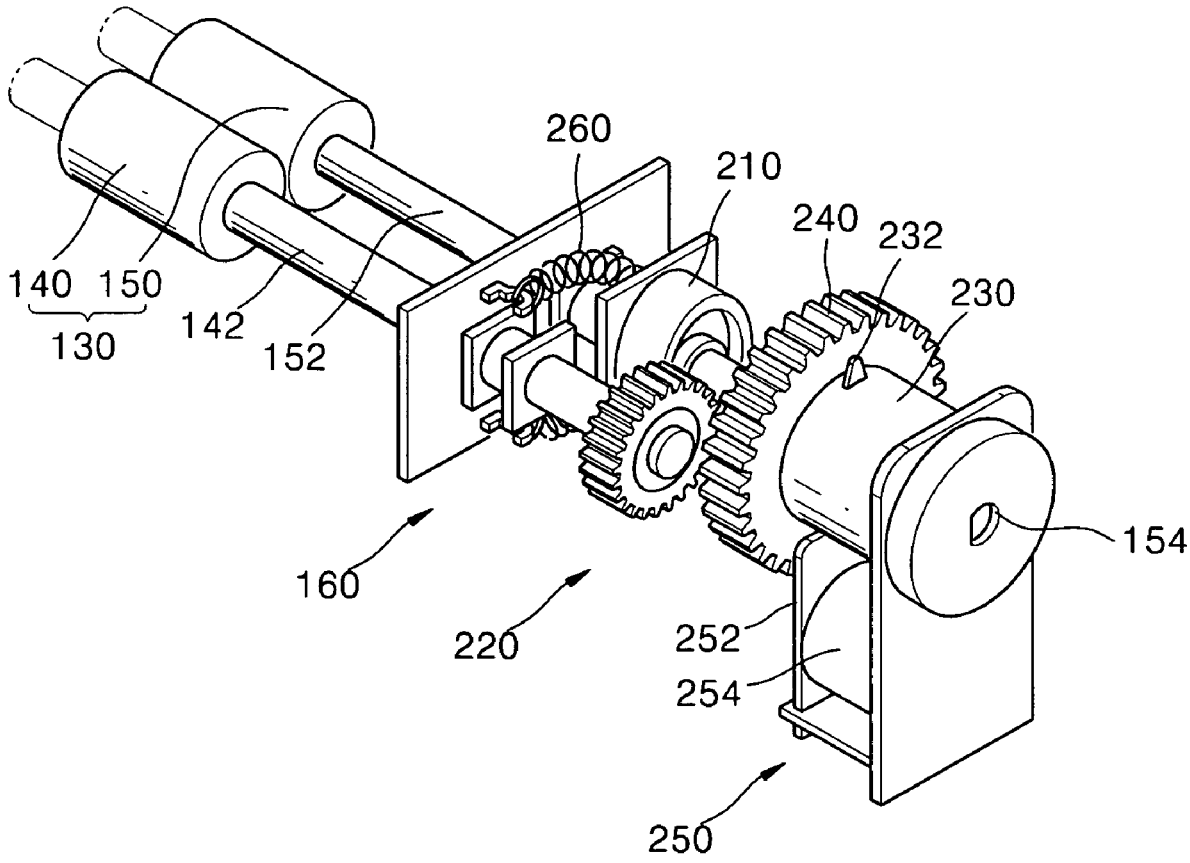
FIG. 3 is an enlarged perspective view of a portion of the paper feeding device shown in FIG. 2.
Figure 6:
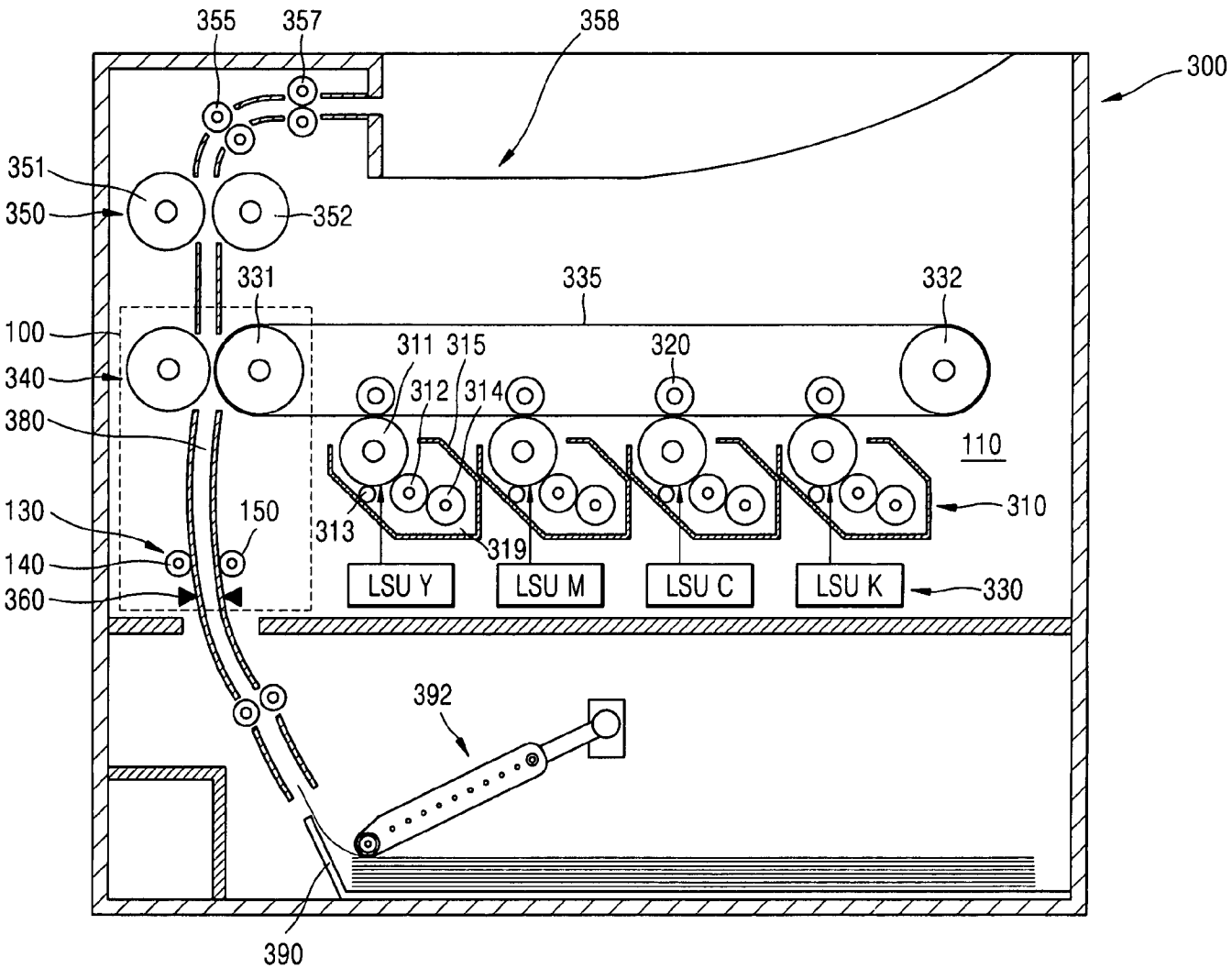
FIG. 6 is a cross-sectional view of an image forming apparatus in accordance with another embodiment of the present invention.

FIG. 2 is a perspective view of a paper feeding device according to an embodiment of the present invention. FIG. 3 is an enlarged perspective view of a portion of the paper feeding device shown in FIG. 2. FIG. 6 is a cross-sectional view of an image forming apparatus according to an embodiment of the present invention.

Referring to FIG. 2, a paper feeding device 100 according to an embodiment of the present invention comprises an image forming unit 110 which forms an image on a sheet of paper. A paper feeding unit 120 includes a roller portion 130 to transfer the paper to the image forming unit 110. A paper-feeding controlling unit 160 operates the roller portion 130 to interrupt a transfer force to the paper if necessary.

The paper feeding device 120 provides a transferring force to a sheet of paper having a first side and a second side opposite to the first side. The paper feeding device 120 includes the roller portion 130. The roller portion 130 includes a driving roller 140 which is rotated by a rotating force transferred from a driving source (not shown) and a passive roller 150 which is driven by the driving roller 140.

The driving roller 140 is arranged on a first shaft 142 which corresponds to the first side of the paper. The driving roller 140 transfers the paper by a rotating force transferred from the driving source. The passive roller 150 is arranged on a second shaft 152 which is parallel to the first shaft 142 and corresponds to a second side of the paper. The passive roller 150 presses the paper toward the driving roller 140 under a predetermined pressure. Moreover, the pressure roller independently rotates around the second shaft 152. The paper is fed between the driving roller 140 and the passive roller 150 for transfer.

The paper-feeding controlling unit 160 comprises a controlling portion 210 installed on the second shaft 152 and a clutch portion 220 to control the operation of the controlling portion 210. The controlling portion 210 controls a transfer force generated by the driving roller 140 by separating the first shaft 142 and the second shaft 152 from each other. The first shaft 142 and the second shaft 152 are moved into contact with and separated each other by the controlling portion 210. The controlling portion 210 is disposed on the second shaft 152 and rotated. The controlling portion 210 may be a pair of cam members installed on both ends of the second shaft 152 in the state where the driving roller 140 is placed between the pair of cam members. Both ends of the second shaft 152 are processed in the form of a substantially D-cut portion 154. The controlling portion 210 and a stopper 230, which will be described later for purposes of clarity and conciseness, may be combined with each other and installed in the D-cut portion 154. In the present embodiment, the controlling portion 210 separates the driving roller 140 and the passive roller 150 from each other by pushing the first shaft 142. The controlling part 210 is installed on the same shaft as the second shaft 152 and is rotated by a rotating force transferred from the second shaft 152 only when the passive roller 150 needs to be separated from the driving roller 140.

When the transfer force generated by the driving roller 140 needs to be controlled, the clutch portion 220 pivots the controlling portion 210 installed on the second shaft 152 by transferring a rotating force to the second shaft 152 when the transferring force needs to be controlled. The clutch portion 220 comprises a stopper 230, a driving member 240, and a locking part 250.

The stopper 230 is a preferably substantially pipe-shaped member and substantially encases the second shaft 152. The stopper 230 is fixedly installed on the second shaft 152 and rotates with the second shaft 152. At least one protrusion 232 is formed on an outer circumference of the stopper 230. In the present embodiment, two protrusions 232 are formed on the outer circumference of the stopper 230; however, other suitable arrangements and constructions maybe used.

The driving member 240 is combined with the outer circumference of the stopper 230. The driving member 240 is rotated by a rotating force transferred from a driving source (not shown) and transfers a rotating force to the stopper 230. The driving member 240 may be a gear.

The locking part 250 includes a trigger 252 and a confinement member 254 to lock or unlock the stopper 230. When locked, the stopper 230 cannot be rotated by a rotating force generated by the driving member 240. The trigger 252 locks the stopper 230 with the protrusion 232. The confinement member 254 confines the operation of the trigger 252 so that the trigger 252 contacts with or releases the protrusion from in the stopper 230. A solenoid that operates in response to an electrical signal may be used as the confinement member 254. If the solenoid is electrically conducted by the electrical signal, a magnetic force is generated. The trigger 252 is pulled by magnetic force. As the trigger 252 moves away from and out of contact with the protrusion 232, the stopper 230 is rotated. Thus, the second shaft 252 and the stopper 230 are rotated. The controlling portion 210 is also rotated. That is, when a rear end of the paper passes through the roller portion 130, the solenoid which is the confinement member 254 releases the protrusion 232 by operating the trigger 252. If the stopper 230 is unlocked in this manner, the second shaft 152 on which the stopper 230 is fixedly installed, is rotated together with the stopper 230 by a rotating force generated by the driving member 240. The controlling portion 210 installed on the second shaft 152 is rotated so that the first shaft 142 and the second shaft 152 are moved into contact with or separated from each other. If the rear end of the paper passes through the roller portion 130, the confinement member 254 operates the trigger 252 to interfere with the stopper 230 to prevent rotation.

A coil spring 260 may be installed to elastically bias the second shaft 152. Thus, the second shaft 152 separates from the first shaft 142 by the controlling portion 210 and is again close to the first shaft 142.

As shown in FIG. 6, a sensor 360 may be disposed on the paper feeding device 100. The sensor 360 operates the paper-feeding controlling unit 160 by sensing time when the rear end of the paper passes between the driving roller 140 and the passive roller 150. The confinement member 254 is operated according to transfer speed of the paper and a distance between the sensor 360 and the roller portion 130 from a time when the sensor 360 senses passage of the rear end of the paper.

The operation of the paper feeding device according to an embodiment of the present invention will now be described with reference to FIGS. 4A-4D and FIGS. 5A-5C.

Figure 4A:
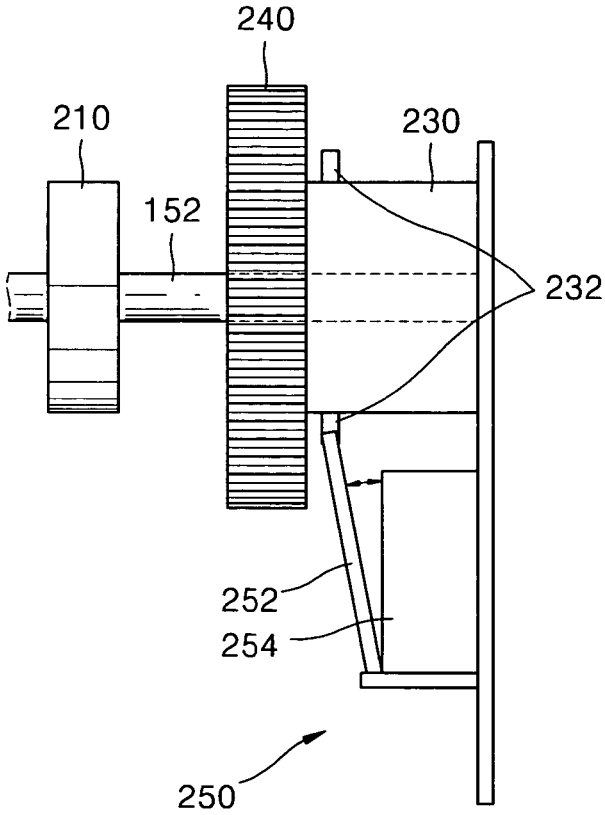
FIGS. 4A through 4D are cross-sectional views showing the operation of the paper-feeding controlling unit shown in FIG. 3.
Figure 4B:
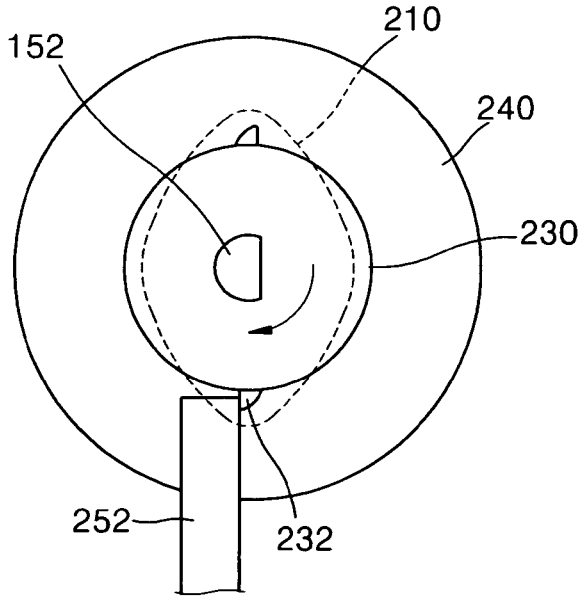
Figure 4C:
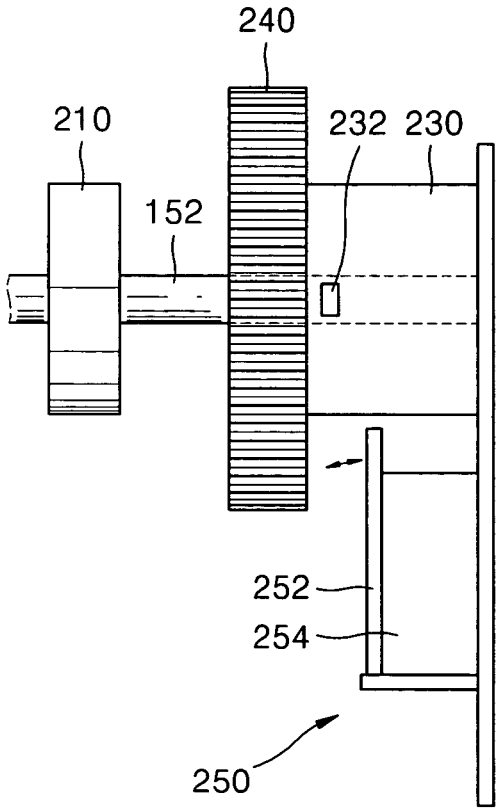
Figure 4D:
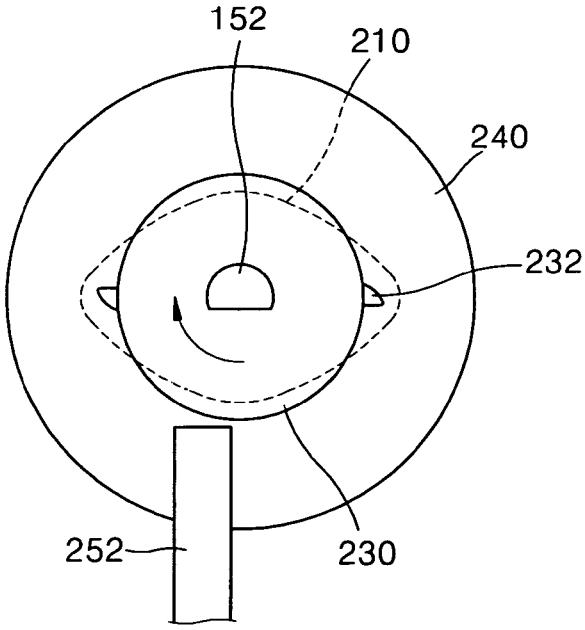
Figure 5A:
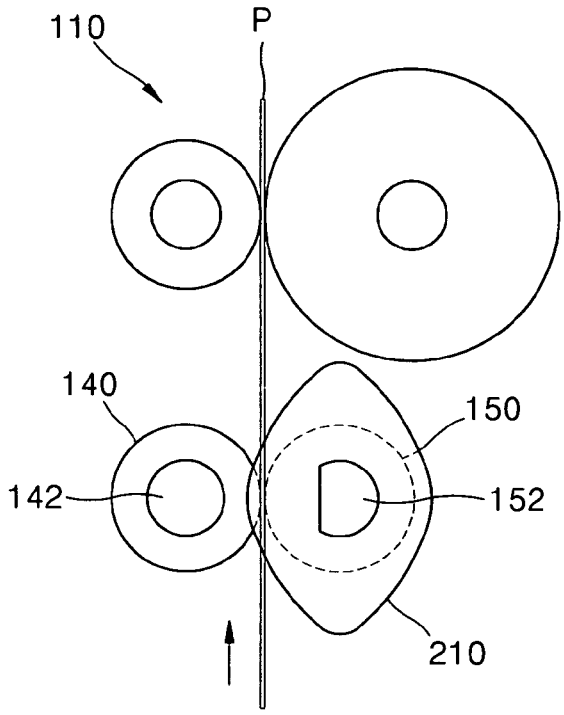
FIGS. 5A through 5C show the operation of the paper feeding device when the paper is transferred.
Figure 5B:
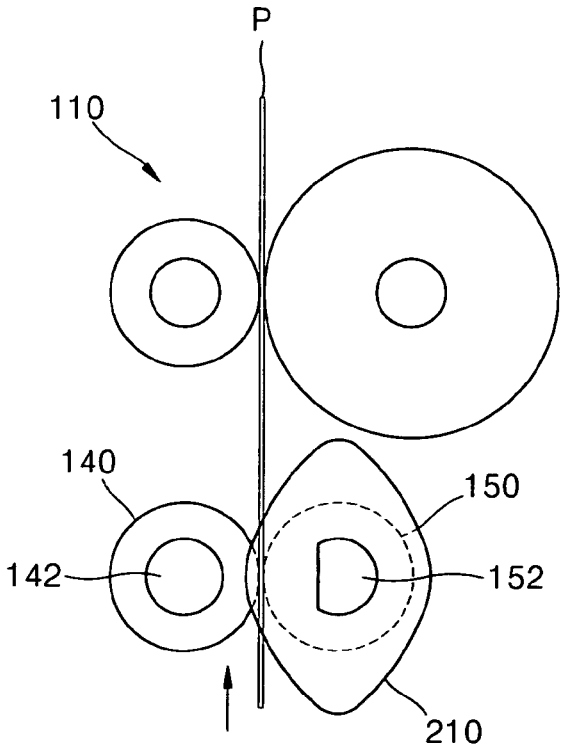
Figure 5C:
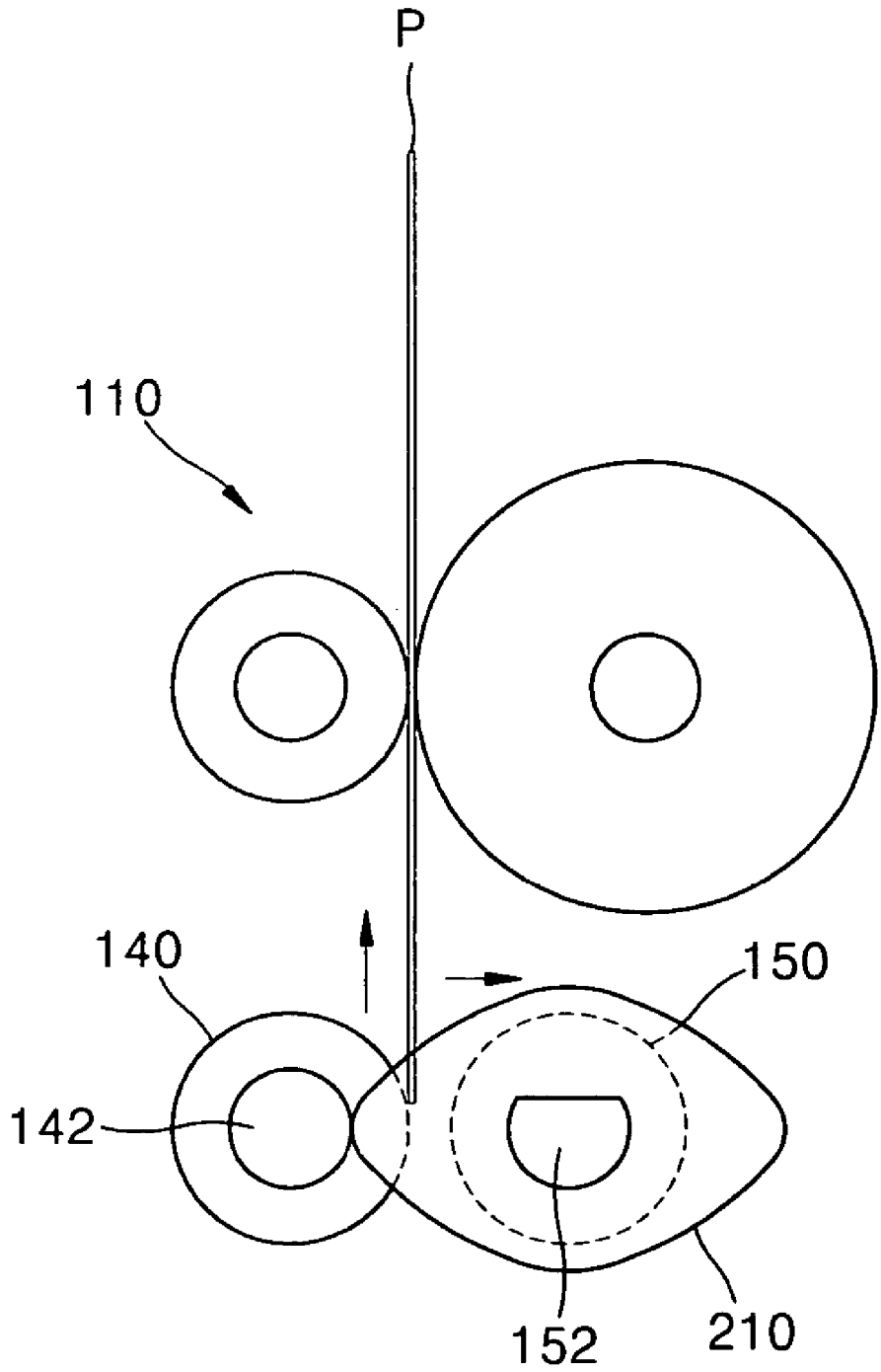

FIGS. 4A-4D are cross-sectional views showing the operation of the paper-feeding controlling unit 160 shown in FIG. 3. FIGS. 5A-5C show the operation of the paper feeding device when the paper is transferred.

While the front end of the paper passes between the driving roller 140 and the passive roller 150 and is fed, since the protrusion 232 is blocked by the trigger 252, and the stopper 230 is not rotated. This occurs even though the driving member 240 is rotated, as shown in FIGS. 4A-4B. Thus, the controlling portion 210 installed on the same shaft as the second shaft 152 on which the stopper 230 is fixedly installed is not rotated.

If the rear end of the paper passes through the sensor 360, the confinement member 254 operates according to the transfer speed of the paper and a distance between the sensor 360 and the roller portion 130 from a time when the sensor 360 senses passage of the rear end of the paper. The confinement member 254 releases the protrusion 232 formed on the outer circumference of the stopper 230 by operating the trigger 252. Thus, the stopper 230 is released by the protrusion 232 and is rotated by a rotating force transferred from the driving member 240. The second shaft 152 with which the stopper 230 is combined is rotated together with the stopper 230. As such, the confinement member 254 installed on the second shaft 152 is rotated and the first shaft 142 and the second shaft 152 are separated from each other. Thus, the rear end of the paper passes through the roller portion 130. As a result, when the rear end of the paper passes through the roller portion 130, unnecessary external forces are not applied to the rear end of the paper. As shown in FIGS. 4C-4D, if the confinement member 254 is continuously rotated around the second shaft 152, the roller portion 130 separates due to a elastic restoration force of the coil spring 260. If the rear end of the paper passes through the roller portion 130, the confinement member 254 again interferes with the protrusion 232 formed on the stopper 230. Thus, the stopper 230 is confined by the trigger 252 and stops rotating. As such, the paper feeding device 100 returns to the states shown in FIGS. 4A and 4B.

As described above, a series of operations of the paper feeding device 100 take place when the paper is transferred as shown in FIGS. 5A, 5B, and 5C.

An image forming apparatus according to an embodiment of the present invention will now be described with reference to the accompanying drawings. While an image forming apparatus using an intermediate transfer method will be described in the present embodiment, embodiments of the present invention is not limited to this and various changes in form and details may be made.

FIG. 6 is a cross-sectional view of an image forming apparatus according to an embodiment of the present invention. Referring to FIG. 6, an image forming apparatus 300 comprises an image forming unit 110 which forms an image on a paper, a paper feeding cassette 390 on which the paper is stacked, a pickup unit 392 which picks up the paper from the paper feeding cassette 390, and a paper feeding device 100 which transfers the paper.

The image forming unit 110 comprises four-color developers 310C, 310M, 310Y, and 310K in which each of toners having four colors such as cyan (C), magenta (M), yellow (Y), and black (K) is held. The image forming unit 110 also includes a first transfer portion 320, exposure portions 330C, 330M, 330Y, and 330K, and an intermediate transfer belt 335.

Each of the exposure portions 330C, 330M, 330Y, and 330K radiates light corresponding to image information about cyan (C), magenta (M), yellow (Y), and black (K) colors onto a photosensitive drum 311 of each of developing cartridges 310C, 310M, 310Y, and 310K. This is done in response to a signal input from a computer. In the present embodiment, a laser scanning unit (LSU) that uses a laser diode as a light source is used as the exposure portions 330C, 330M, 330Y, and 330K.

Each of the developing cartridges 310C, 310M, 310Y, and 310K comprises the photosensitive drum 311, a developing roller 312, a charging roller 313, a supplying roller 314, a storage part 319, a toner layer regulating member (not shown), and a cleaning member (not shown). The photosensitive drum 311 is installed so that a portion of an outer circumference of the photosensitive drum 311 is exposed. The photosensitive drum 311 is rotated in a predetermined direction. A photoconductive material layer is coated on the outer circumference of a metallic drum.

A charging bias voltage is applied to the charging roller 313 so as to charge the outer circumference of the photosensitive drum 311 to a uniform potential. A corona discharger (not shown) may be used instead of the charging roller 313.

The developing roller 312 supplies toner to the photosensitive drum 311 by adhering toners to the outer circumference of the developing roller 312. Solid powdery toners are held in the developing roller 312, and the developing roller 312 develops a toner image by supplying the toners to an electrostatic latent image formed on the photosensitive drum 311. A development bias voltage to supply the toners to the photosensitive drum 311 is applied to the developing roller 312.

The supplying roller 314 adheres the toners to the developing roller 312 and is installed outside the developing roller 312. The toner layer regulating member (not shown) regulates the amount of toner adhered to the developing roller 312 and is installed on housing 315.

Each of the developing cartridges 310C, 310M, 310Y, and 310K may further comprise an agitator (not shown) which agitates the toners held in each of the developing cartridges 310C, 310M, 310Y, and 310K so that the toner does not harden.

The cleaning member (not shown) is installed on housing 315 and contacts the photosensitive drum 311 under predetermined pressure so that one end of the cleaning member contacts the photosensitive drum 311. The toners remaining on the photosensitive drum 311 are scratched after a transfer operation is performed. The other-side edge of the cleaning member (not shown) contacts the photosensitive drum 311 under predetermined pressure so that one end of the cleaning member contacts the photosensitive drum 311. The toners remaining on the photosensitive drum 311 are scratched after a transfer operation is performed. A waste toner storage portion (not shown) is disposed in the developing cartridges 310C, 310M, 310Y, and 310K and the toners removed from the photosensitive drum 311 by the cleaning member (not shown) are stored in the waste toner storage portion (not shown).

Each of the developing cartridges 310C, 310M, 310Y, and 310K comprises an opening (not shown) which forms a path so that light scanned by the exposure portions 330C, 330M, 330Y, and 330K is irradiated onto the photosensitive drum 311. An outer circumference surface of the photosensitive drum 311 exposed to an outside of each of the developing cartridges 310C, 310M, 310Y, and 310K faces the intermediate transfer belt 335.

One side of the intermediate transfer belt 335 is disposed to face the photosensitive drum 311. The other side thereof is disposed to face the first transfer portion 320. The intermediate transfer belt 335 is supported by a plurality of support rollers 331 and 332 and circulated.

The four first transfer units 320 are disposed to face the photosensitive drum 311 of each of the developing cartridges 310C, 310M, 310Y, and 310K in the state where the intermediate transfer belt 335 is placed between the first transfer units 320 and the photosensitive drum 311. In the present embodiment, a transfer bias voltage, having a polarity opposite to that of the toner image, is applied to the first transfer units 320. Consequently, the toner image developed on the photosensitive drum 311 is transferred onto the paper. The toner image is transferred onto the intermediate transfer belt 335 by a electrostatic force that acts between the photosensitive drum 311 and the first transfer units 320.

A second transfer unit 340 is disposed to face the support roller 331 in the state where a transfer path through which the paper passes is placed between the second transfer unit 340 and the support roller 331. In the present embodiment, a transfer bias voltage having a polarity opposite to that of the toner image is applied to the second transfer unit 340. Thus, the toner image that has been primarily transferred onto the intermediate transfer belt 335 is transferred onto the paper. The toner image is transferred onto the paper by a electrostatic force that acts between the intermediate transfer belt 335 and the second transfer unit 340.

A fusing unit 350 includes a heating roller 351 and a pressing roller 352. The fusing unit 350 fuses the toner image on the paper by applying heat and pressure to the toner image. The heating roller 351 is used as a heat source for permanently sticking the toner image installed to face the pressing roller 352 in an axial direction. The pressing roller 352 is installed to face the heating roller 351 and fuses the toner image on the paper by applying high pressure to the paper.

A decurler unit 355 eliminates curls produced on the paper by heat when the paper passes through the fusing unit 350. Paper discharging rollers 357 discharge the paper, on which a fusing operation has been completed, outside the image forming apparatus 300. The paper is discharged by the paper discharging rollers 357 along a paper transfer path 380 from the image forming unit 110 outside the image forming apparatus 300 and is stacked on a paper discharging unit 358.

The pickup unit 392 is installed in a one-side upwardly extending direction of the paper feeding cassette 390 and transfers the paper to the paper feeding device 100. The paper picked-up by the pickup unit 392 is discharged by the paper discharging rollers 357 outside the image forming apparatus 300 via the image forming unit 110.

The paper feeding device 100 is installed along the paper transfer path 380. The paper feeding device 100 shown in FIG. 2 according to an embodiment of the present invention is used as the paper feeding device 100. The structure and operation of the paper feeding device 100 are as shown in FIG. 2.

The operation of the image forming apparatus according to an embodiment of the present invention will now be described.

The photosensitive drum 311 of each of the developing cartridges 310C, 310M, 310Y, and 310K is charged by the charging bias voltage applied to the charging roller 313 to a uniform electric potential. Each of the four exposure units 330C, 330M, 330Y, and 330K radiates light corresponding to image information about colors such as yellow (Y) and magenta (M) of image onto the photosensitive drum 311 of each of the developing cartridges 310, 310M, 310Y, and 310K via an opening (not shown). If light is scanned by each of the developing cartridges 310C, 310M, 310Y, and 310K, only a scanned portion is selectively erased such that an electric potential is reduced. Thus, an output pattern formed by this potential difference is an electrostatic latent image.

The toner is supplied to the developing roller 312 to which the development bias voltage is applied by the supplying roller 314. The toner adhered to the outer circumference of the developing roller 312 becomes thinner due to a uniform thickness of the toner layer regulating unit (not shown). In this case, the toner is friction-charged by the developing roller 312 and the toner layer regulating unit (not shown). The toner adhered to the outer circumference of the developing roller 312 is then adhered to the electrostatic latent image formed on the outer circumference of the photosensitive drum 311. Thus, the toner images having colors such as cyan (C), magenta (M), yellow (Y), and black (K) are formed on the photosensitive drum 311 of each of the developing cartridges 310C, 310M, 310Y, and 310K.

The paper is drawn out from the paper feeding cassette 390 by the pickup unit 392. The paper is fed into a transfer nip of the second transfer unit 340 by the paper feeding device 100. The paper is transferred at the same velocity as a traveling linear velocity of the intermediate transfer belt 335. The front end of the paper reaches the transfer nip when the front end of the toner image that has been primarily transferred onto the intermediate transfer belt 335 by each of the developing cartridges 310C, 310M, 310Y, and 310K faces the transfer nip that faces the second transfer unit 340.

As described above, the toner image that has been primarily transferred onto the intermediate transfer belt 335 and is transferred onto the paper when the paper passes between the second transfer unit 340 to which the transfer bias voltage is applied and the support roller 331.

The toner that remains on the outer circumference of the photosensitive drum 311 after the above-described transfer operation is completed, is removed by a cleaning member (not shown). The fusing unit 350 then fuses the toner image on the paper by applying heat and pressure to the toner image formed on the paper. The decurler unit 355 eliminates curl produced on the paper when the paper passes through the fusing unit 355. The paper that passes through the decurler unit 355 is discharged outside the image forming apparatus 300 by the paper discharging rollers 357. The paper discharged by the paper discharging rollers 357 is stacked on the paper discharging unit 358.

According to the above-described configuration, in the paper feeding device 100 and the image forming apparatus 300, the controlling portion 210 which separates the roller portion 130 from the paper feeding device 100 is disposed on the second shaft 152 in such a manner that unnecessary external forces are prevented from acting on the paper. Moreover, an additional driving unit for separating the roller portion 130 from the paper feeding device 100 is not needed.

As described above, in the paper feeding device and the image forming apparatus having the same, the roller portion can be simply separated from the paper feeding device. Since a space for implementing the paper feeding device becomes smaller, the paper feeding device and the image forming apparatus can be minimized. Since unnecessary external forces that act when the rear end of the paper passes through the roller portion are reduced, improved image quality can be realized. In addition, since an additional driving source for driving the controlling portion is not required, costs are reduced. Power consumption of the paper feeding device and the image forming apparatus can also be reduced.

While the present invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A paper feeding device, comprising:

an image forming unit;

a paper feeding unit to provide a transfer force to a first side and a second side opposite to the first side of a sheet of paper, the paper feeding unit having a first roller being arranged on a first shaft to face the first side of the paper and a second roller being parallel to the first shaft, the second roller being arranged on a second shaft to face the second side of the paper to press the paper toward the first roller; and a paper-feeding controlling unit to operate the first and second rollers to interrupt the transfer force applied to the paper when a rear end of the paper passes through the first and second rollers, the paper-feeding controlling unit having a controlling portion being rotatably installed on the second shaft to control the transfer force generated by the first roller by making the first and second rollers contact or separate from one another by rotation of the controlling portion and a clutch portion to operate the controlling portion installed on the second shaft by transferring a rotating force to the second shaft when to controlling the transfer force, wherein the controlling portion installed on the second shaft pushes the first shaft when the first and second rollers are separated from one another.

2. The device of claim 1, wherein the clutch portion comprises:

a stopper being a substantially pipe-shaped member substantially encasing the second shaft and being fixedly installed on the second shaft;

a driving member being combined with an outer circumference of the stopper and being rotated by a rotating force transferred from a driving source; and a locking part to lock the stopper so that the stopper is not rotated by the rotating force or unlock the stopper so that the stopper is rotated by the rotating force, wherein when the stopper is unlocked, the second shaft on which the stopper is fixedly installed is rotated together with the stopper, the controlling portion installed on the second shaft is rotated so that the first and second shafts are moved into contact with or separated from each other.

3. The device of claim 2, wherein the stopper includes a protrusion protruding from the outer circumference of the stopper, and wherein the locking part comprises:

a trigger to lock or unlock the stopper by positioning the protrusion so that the stopper is not rotated when the trigger locks the stopper; and a confinement member to confine an operation of the trigger so that the trigger positions the protrusion into contact with or releases the protrusion from the trigger.

4. The device of claim 3, wherein the confinement member includes a solenoid to operate in response to an electrical signal.

5. The device of claim 2, wherein the driving member is a gear.

6. The device of claim 1, wherein the controlling portion is a cam member.

7. The device of claim 1, wherein the controlling portion is a pair of cam members formed on both ends of the second shaft in the state where the first roller is placed between the pair of cam members.

8. The device of claim 1, wherein the first and second shafts are wound by a coil spring installed on the first shaft and elastically biased to contact each other.

9. The device of claim 1, further comprising a sensor to sense passage of the rear end of the paper between the first roller and the second roller.

10. An image forming apparatus having a paper feeding device, the paper feeding device comprising:

an image forming unit;

a paper feeding unit to provide a transfer force to a first side and a second side opposite to the first side of a sheet of paper, the paper feeding unit having a first roller being arranged on a first shaft to face the first side of the paper and a second roller being parallel to the first shaft, the second roller being arranged on a second shaft to face the second side of the paper to press the paper toward the first roller; and a paper-feeding controlling unit to operate the first and second rollers to interrupt the transfer force applied to the paper when a rear end of the paper passes through the first and second rollers, the paper-feeding controlling unit having a controlling portion being rotatably installed on the second shaft to control the transfer force generated by the first roller by making the first and second rollers contact or separate from one another by rotation of the controlling portion and a clutch portion to operate the controlling portion installed on the second shaft by transferring a rotating force to the second shaft when to controlling the transfer force, wherein the controlling portion installed on the second shaft pushes the first shaft when the first and second rollers are separated from one another.

11. The apparatus of claim 10, wherein the clutch portion comprises:

a stopper being a substantially pipe-shaped member substantially encasing the second shaft and being fixedly installed on the second shaft;

a driving member being combined with an outer circumference of the stopper and being rotated by a rotating force transferred from a driving source; and a locking part to lock the stopper so that the stopper is not rotated by the rotating force or unlock the stopper so that the stopper is rotated by the rotating force, wherein when the stopper is unlocked, the second shaft on which the stopper is fixedly installed is rotated together with the stopper, the controlling portion installed on the second shaft is rotated so that the first and second shafts are moved into contact with or separated from each other.

12. The apparatus of claim 11, wherein the stopper includes a protrusion protruding from the outer circumference of the stopper, and wherein the locking part comprises:

a trigger to lock or unlock the stopper by positioning the protrusion so that the stopper is not rotated when the trigger locks the stopper; and a confinement member to confine an operation of the trigger so that the trigger positions the protrusion into contact with or releases the protrusion from the trigger.

13. The apparatus of claim 12, wherein the confinement member includes a solenoid to operate in response to an electrical signal.

14. The apparatus of claim 11, wherein the driving member is a gear.

15. The apparatus of claim 10, wherein the controlling portion is a cam member.

16. The apparatus of claim 10, wherein the controlling portion is a pair of cam members formed on both ends of the second shaft in the state where the first roller is placed between a pair of cam members.

17. The apparatus of claim 10, wherein the first and second shafts are wound by a coil spring installed on the first shaft and elastically biased to contact each other.

18. The apparatus of claim 10, further comprising a sensor to sense passage of the rear end of the paper between the first roller and the second roller.

* * * * *